US008662775B1

(12) United States Patent
Liu

(10) Patent No.: US 8,662,775 B1
(45) Date of Patent: Mar. 4, 2014

(54) COSMETIC DEVICE WITH TWO APPLICATORS

(71) Applicant: Li-Mei Liu, Diamond Bar, CA (US)

(72) Inventor: Li-Mei Liu, Diamond Bar, CA (US)

(73) Assignee: Allen & Thomas Cosmetic Accessories Co., Ltd., Zhuhai (CN)

( * ) Notice: Subject to any disclaimer, the term of this patent is extended or adjusted under 35 U.S.C. 154(b) by 0 days.

(21) Appl. No.: 13/794,707

(22) Filed: Mar. 11, 2013

(51) Int. Cl.
*B43K 27/02* (2006.01)

(52) U.S. Cl.
USPC ..... 401/19; 401/17; 401/23

(58) Field of Classification Search
USPC ..... 401/16, 17, 19, 23, 24, 25, 26; 132/317
See application file for complete search history.

(56) References Cited

U.S. PATENT DOCUMENTS 2,398,161 A * 4/1946 Skold ..... 15/244.1
6,450,179 B2 * 9/2002 Bengis ..... 132/297
8,206,050 B2 * 6/2012 Prague ..... 401/175

* cited by examiner

*Primary Examiner* — David Walczak
(74) *Attorney, Agent, or Firm* — Che-Yang Chen; Law Office of Michael Chen

(57) ABSTRACT

A cosmetic device includes a barrel, a first transmission unit, a dispensing unit, a cover and a second transmission unit. The first transmission unit is co-rotated with the collar by rotating the mounting member to move the piston downward. The cosmetic liquid in the first room in the barrel flows out from the outlet of the dispensing unit. The mounting member is rotatable in one direction relative to the barrel by the engagement of the ratchet teeth portion of the collar and the pawl of the barrel. The reception tube of the second transmission unit is rotated to co-rotate the collar to let the rod spirally move in the inner tube to protrude the lipstick.

10 Claims, 6 Drawing Sheets

COSMETIC DEVICE WITH TWO APPLICATORS

FIELD OF THE INVENTION

The present invention relates to a cosmetic device, and more particularly, to a cosmetic device with two applicators.

BACKGROUND OF THE INVENTION

The application developed conventional cosmetic device which is discloses in FIGS. 5 and 6, and generally comprises a hollow locking member 80 which is connected to outside of the first and second barrels 82, 83. When using the second barrel 83, the locking member 80 is moved toward the first barrel 82 to disengage the toothed portion 801 of the locking member 80 from the outer threaded portion 831 of the second barrel 83. The toothed portion 801 is then engaged with the outer toothed portion 821 of the first barrel 82. When rotating the second barrel 83, the collar 923 is rotated and drives the threaded rod 921 to rotate so as to move the piston 922 to squeeze the cosmetic liquid in the second barrel 83. The first barrel 82 can be operated by the same operation processes so that the two applicators can be actuated. However, the operation to the locking member 80 to engage the toothed portion 801 of the locking member 80 with the outer threaded portion of one of the two barrels 82, 83, and then rotating the other barrel to get the cosmetic liquid can be confused by the user to unintentionally rotate the barrel that the user does not intend to use. The direction of the rotation of the barrel and the locking member are easily confused. Besides, the assembling steps of the conventional cosmetic device are complicated, especially for the connected between the first and second barrels, and the cooperation with the collar and the locking member. When one of the above mentioned parts is damaged or not aligned properly, the whole set of the cosmetic device may need to be discard, and the fabrication cost is increased.

The present invention intends to provide a cosmetic device which improves the shortcomings of the conventional cosmetic device.

SUMMARY OF THE INVENTION

The present invention relates to a cosmetic device and comprises a barrel which has a first room and a second room in two ends thereof. An outer tube is mounted to the second room and has a connection section extending from a lower end thereof. A first transmission unit is connected with the first room and has a first collar located in a mounting member, a threaded rod and a piston. The mounting member is rotatably mounted to the first end of the barrel and the first collar is connected to one end of the threaded rod. The piston is threadedly connected to the other end of the threaded rod. A first path is defined centrally through the threaded rod. A dispensing unit has a sleeve, a shaft and an applicator. The sleeve has an end thereof connected to the mounting member and at least one outlet is defined in the lower end thereof. A second path is defined centrally through the shaft which has an end movably inserted in the sleeve. A first cover has multiple ridges extending from the inside thereof and a locking portion is defined in the first cover. The ridges are engaged with the first connection portion to secure the first cover to the mounting member. The locking portion is locked to the outside of the shaft. A second transmission unit is located in the outer tube and has an inner tube, a second collar, a rod and a reception tube. The inner tube has a threaded portion in the center thereof. The second collar has multiple rails in the central passage thereof and the second collar is rotatably mounted to the inner tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
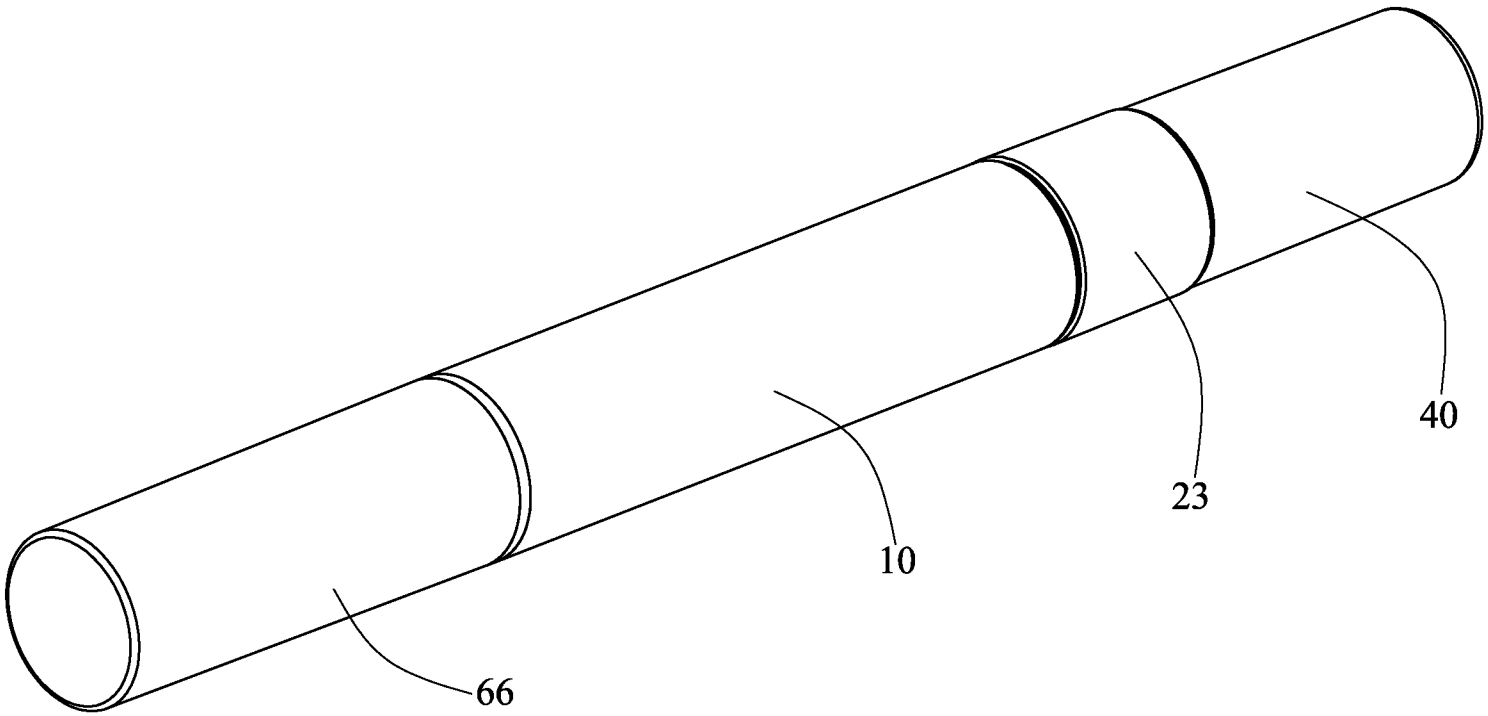
FIG. 1 is a perspective view to show the cosmetic device of the present invention.
Figure 2:
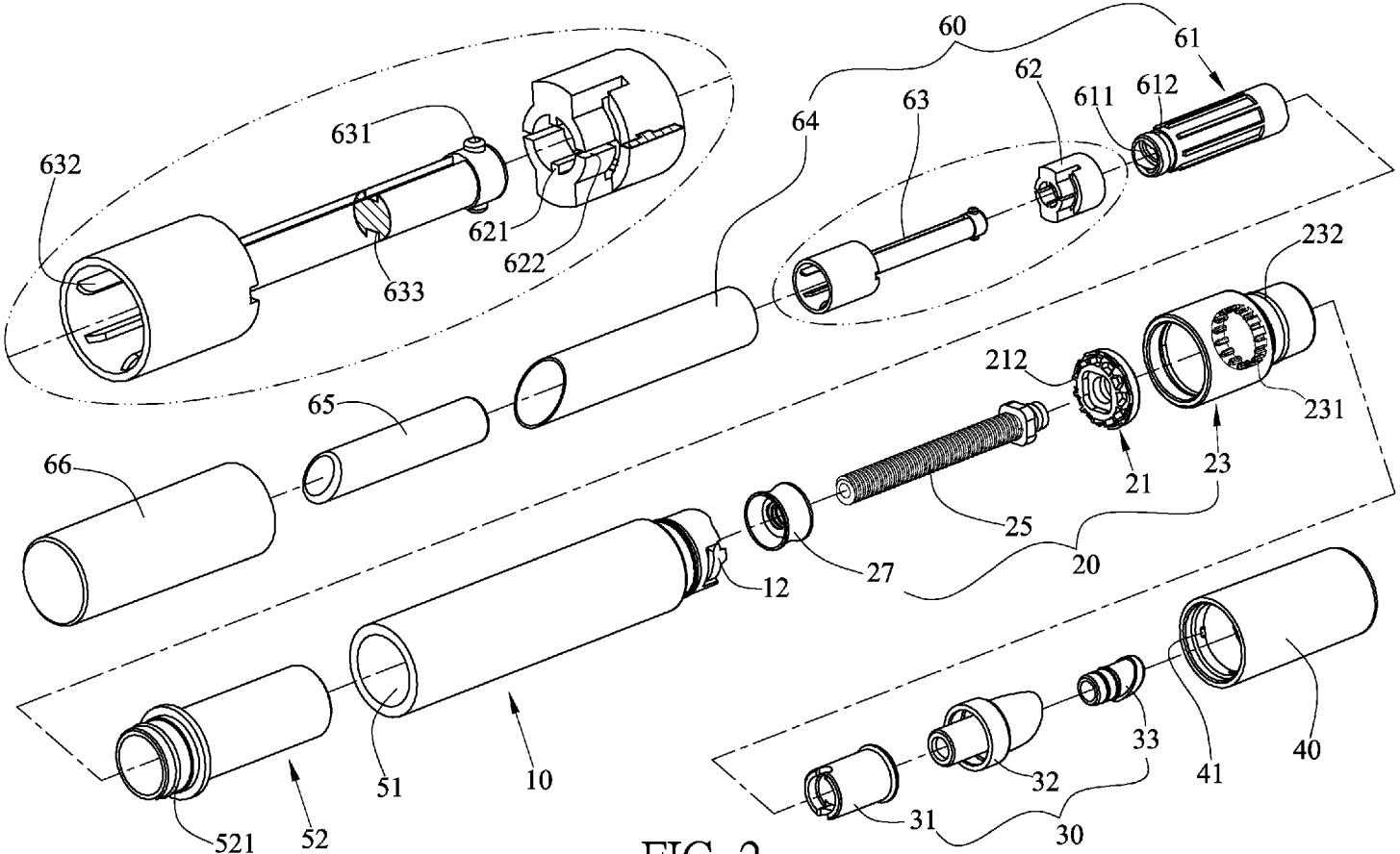
FIG. 2 is an exploded view to show the cosmetic device of the present invention.

Referring to FIGS. 1 to 4, the cosmetic device of the present invention comprises a barrel 10 having a first room 11 defined in the first end thereof, and a second room 51 is defined in the second end of the barrel 10. The first room 11 receives cosmetic liquid therein. An outer tube 52 is mounted to the second room 51 and has a connection section 53 extending from the lower end thereof. The barrel 10 further has a pawl 12 connected to the first end thereof.

A first transmission unit 20 is connected with the first room 11 and has a first collar 21 located in a mounting member 23, a threaded rod 25 and a piston 27. The mounting member 23 is rotatably mounted to the first end of the barrel 10 and has a first connection portion 232 on an outside thereof. The mounting member 23 has a toothed portion 231 defined in the inside of the middle section thereof. The first collar 21 has outer teeth 211 which are engaged with the toothed portion 231 to restrict the first collar 21 in the mounting member 23. The first collar 21 is secured to one end of the threaded rod 25 and the piston 27 is threadedly connected to the other end of the threaded rod 25. A first path 251 is defined centrally through the threaded rod 25. When rotating the mounting member 23, the first collar 21 is co-rotated so as to rotate the threaded rod 25. The piston 27 is linearly moved in the first room 11. The first collar 21 has a ratchet teeth portion 212 located in opposite to the outer teeth 211. The ratchet teeth portion 212 is engaged with the pawl 12 to restrict the first collar 21 so it is rotated in one direction relative to the barrel 10.

A dispensing unit 30 has a sleeve 31, a shaft 32 and an applicator 33. The sleeve 31 has an end thereof connected to the mounting member 23 and at least one outlet 310 is defined in the lower end thereof. The sleeve 31 has an outward lip 312 on the top end thereof. A second path 321 is defined centrally through the shaft 32. The shaft 32 has an annular protrusion 322 extending from the middle section thereof. The annular protrusion 322 has an inward lip 323. The shaft 32 has an end linearly and movably inserted in the sleeve 31. The inward lip 323 contacts the outward lip 312 to prevent the shaft 32 from being pulled out. The applicator 33 is connected to the shaft 32 and the applicator 33 is a brush or a sponge. The sleeve 31 has a protrusion 311 extending from the lower end thereof and the protrusion 311 is engaged with one end of the second path 321 so as to seal the outlet 310 to prevent leakage.

A first cover 40 has multiple ridges 41 extending from the inside thereof and a locking portion 42 is defined in the first cover 40. The ridges 41 are engaged with the first connection portion 232 to secure the first cover 40 to the mounting member 23. The first cover 40 is securely connected to the shaft 32 by the locking portion 42 of the first cover 40 being locked on the outside of the shaft 32. Therefore, when the shaft 32 moves linearly, the cosmetic liquid does not leak. When opening the first cover 40, the shaft 32 can be pulled out so as to open the outlet 310.

A second transmission unit 60 is located in the outer tube 52 and has an inner tube 61, a second collar 62, a rod 63 and a reception tube 64. The inner tube 61 has a threaded portion 611 in the center thereof and a first end of the inner tube 61 is connected to the connection section 53. The second end of the inner tube 61 has an annular groove 612 in the outside of the second end thereof. The second collar 62 has multiple rails 621 in the central passage thereof and is rotatably mounted to the inner tube 61. The rails 621 are equally spaced apart from each other. The second collar 62 has two slits 622 defined therein and being equally spaced apart from each other. The second collar 62 has a convex portion 623 which is engaged with the annular groove 612. The rod 63 has two guide blocks 631 on the first end thereof and the middle section of the rod 63 has multiple guide slots 633 which are located corresponding to the rails 621. The guide blocks 631 are threadedly connected to the threaded portion 611 and the rails 621 are linearly mounted to the guide slots 633. The second end of the rod 63 has a lipstick 65 received therein. The rod 63 has multiple ribs 632 located axially on the inside of the second end thereof and the ribs 632 are inserted into outside of the lipstick 65 so as to secure the lipstick 65. The outer tube 52 has a second connection portion 521 and the second cover 66 has a third connection portion 661 defined in the inside thereof. The second and third connection portions 521, 661 are connected with each other.

The slits 622 allow the rod 63 and the guide blocks 631 to be easily extended through the second collar 62.

When the user opens the second cover 66 and rotates the reception tube 64 which co-rotates the second collar 62. The rod 63 is spirally moved relative to the inner tube 61 so as to extend the lipstick 65 out from the reception tube 64.

Figure 3:
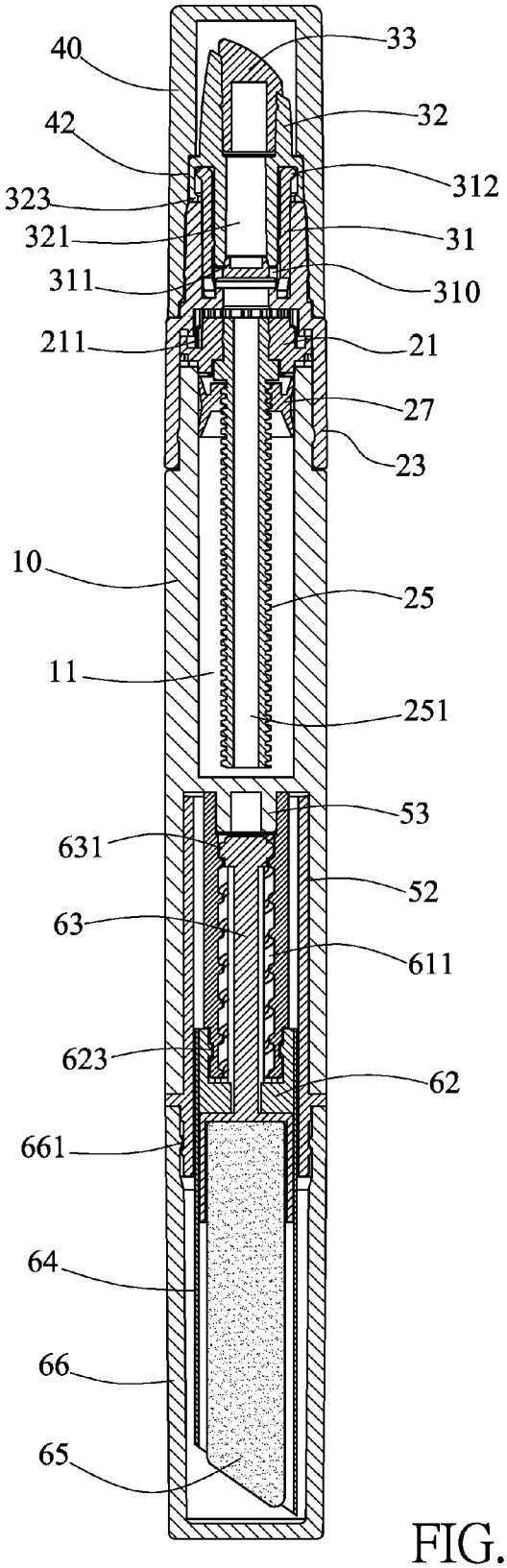
FIG. 3 is a cross sectional view of the cosmetic device of the present invention.
Figure 4:
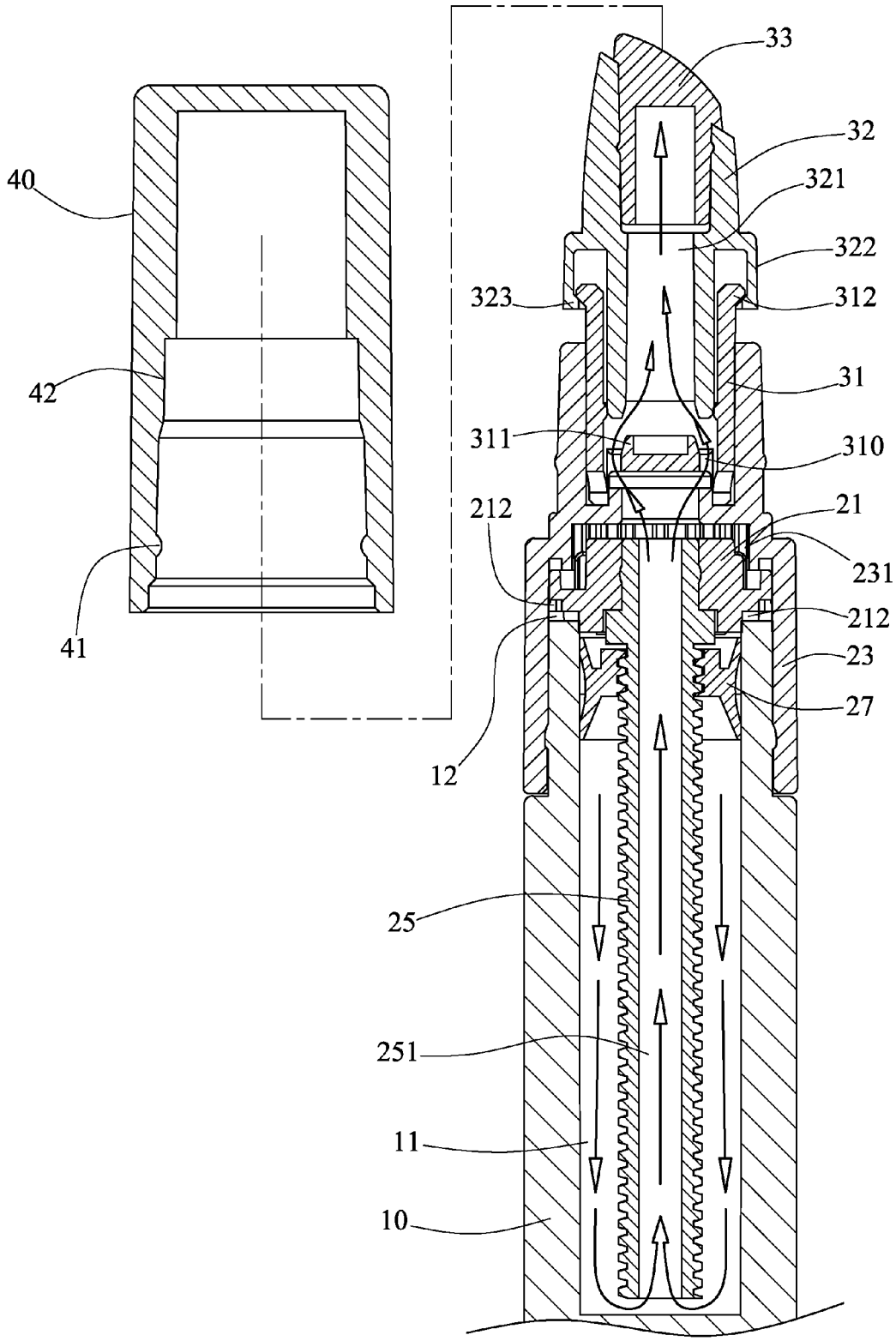
FIG. 4 shows the flowing of the cosmetic liquid in the cosmetic device of the present invention.
Figure 5:
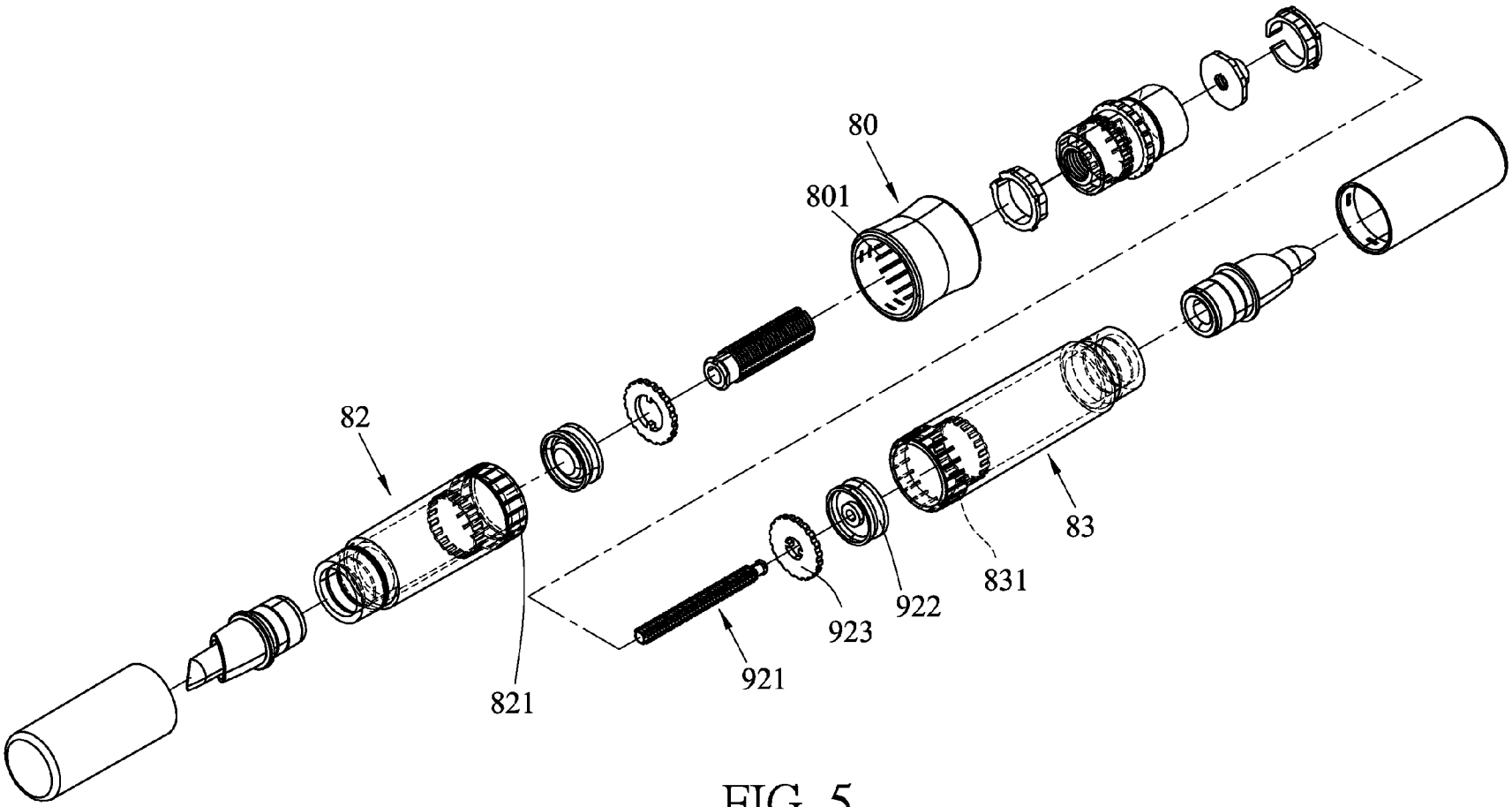
FIG. 5 PRIOR ART
FIG. 5 is an exploded view to show the conventional cosmetic device.
Figure 6:
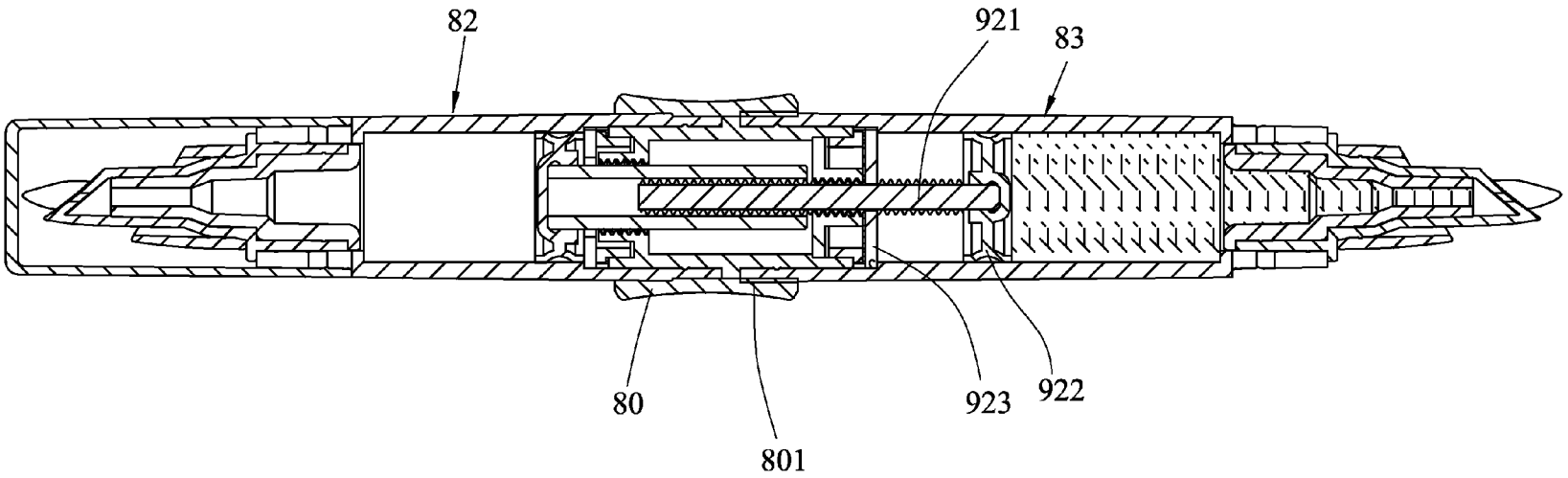
FIG. 6 PRIOR ART
FIG. 6 is a cross sectional view of the conventional cosmetic device.

As shown in FIG. 4, when the user opens the first cover 40 which pulls the shaft 32 upward by the locking portion 42, the second path 321 is removed from the protrusion 311 and opens the outlet 310. The user then rotates the mounting member 23 to co-rotate the first collar 21. The threaded tube 25 is then rotated to move the piston 27 downward such that the cosmetic liquid in the first room 11 flows to the applicator 33 via the first path 251, the outlet 310 and the second path 321. By the engagement between the pawl 12 of the barrel 10 and the ratchet teeth portion 212 first collar 21, the mounting member 23 can only rotate in one direction relative to the barrel 10 and is properly restricted. The user cannot counter rotate the mounting member 23 when applied by less force. By this way, the amount of the cosmetic liquid in the first room 11 that flows out can be controlled. When the use of the cosmetic liquid is finished, the first cover 40 is re-capped, as shown in FIG. 3, the shaft 32 is pushed back by the locking portion 42 of the first cover 40, and the protrusion 311 is connected to the second path 321 again to close the outlet 310 to prevent the cosmetic liquid from leakage.

The amount of the cosmetic liquid in the first room 11 that flows out can be controlled by rotation of the mounting member 23, and the lipstick 65 is controlled by rotating the reception tube 64. This prevents the user from unintentionally rotating the barrel 10. By the engagement between the pawl 12 of the barrel 10 and the ratchet teeth portion 212 first collar 21, the mounting member 23 can only rotate in one direction relative to the barrel 10 so as to prevent the user from overly rotating and damaging the cosmetic device. When the first cover 40 is re-capped, the protrusion 311 is connected to the second path 321 and the outlet 310 is closed to prevent the cosmetic liquid from leakage. The ribs 632 are inserted into outside of the lipstick 65 to secure the lipstick 65.

While we have shown and described the embodiment in accordance with the present invention, it should be clear to those skilled in the art that further embodiments may be made without departing from the scope of the present invention.

What is claimed is:

1. A cosmetic device comprising:

a barrel having a first room defined in a first end thereof, a second room defined in a second end of the barrel, the first room adapted to receive cosmetic liquid, an outer tube mounted to the second room and having a connection section extending from a lower end thereof;

a first transmission unit connected with the first room and having a first collar located in a mounting member, a threaded rod and a piston, the mounting member rotatably mounted to the first end of the barrel and having a first connection portion on an outside thereof, the first collar to one end of the threaded rod and the piston threadedly connected to the other end of the threaded rod, a first path defined centrally through the threaded rod;

a dispensing unit having a sleeve, a shaft and an applicator, the sleeve having an end thereof connected to the mounting member and at least one outlet defined in a lower end thereof, a second path defined centrally through the shaft, the shaft having an end movably inserted in the sleeve;

a first cover having multiple ridges extending from an inside thereof and a locking portion defined in the first cover, the ridges engaged with the first connection portion to secure the first cover to the mounting member, the locking portion of the first cover locked on an outside of the shaft;

a second transmission unit located in the outer tube and having an inner tube, a second collar, a rod and a reception tube, the inner tube having a threaded portion in a center thereof and a first end of the inner tube connected to the connection section, the second collar having multiple rails in a central passage thereof and rotatably mounted to the inner tube, the rod having two guide blocks on a first end thereof and a middle section of the rod having multiple guide slots which are located corresponding to the rails, the guide blocks threadedly connected to the threaded portion and the rails linearly mounted to the guide slots, a second end of the rod having a lipstick received therein, the reception tube mounted to the second collar, a second cover mounted to the outer tube.

2. The device as claimed in claim 1, wherein the mounting member has a toothed portion defined in an inside of a middle section thereof, the first collar has outer teeth which are engaged with the toothed portion to restrict the first collar in the mounting member.

3. The device as claimed in claim 2, wherein the barrel has a pawl connected to the first end thereof and the first collar has a ratchet teeth portion located in opposite to the outer teeth, the ratchet teeth portion is engaged with the pawl to restrict the first collar to rotation in one direction relative to the barrel.

4. The device as claimed in claim 1, wherein the sleeve has a protrusion extending from a lower end thereof and the protrusion is engaged with one end of the second path.

5. The device as claimed in claim 1, wherein the applicator is a brush or a sponge.

6. The device as claimed in claim 1, wherein the sleeve has an outward lip on a top end thereof and the shaft has an annular protrusion extending from a middle section thereof, the annular protrusion has an inward lip which contacts the outward lip to prevent the shaft from being pulled out.

7. The device as claimed in claim 1, wherein the inner tube has an annular groove defined in an outside of a second end thereof, the second collar has a convex portion which is engaged with the annular groove.

8. The device as claimed in claim 1, wherein the second collar has two slits defined therein and equally spaced apart from each other, the rails are equally spaced apart from each other.

9. The device as claimed in claim 1, wherein the rod has multiple ribs located axially on an inside of a second end thereof and the ribs are inserted into outside of the lipstick.

10. The device as claimed in claim 1, wherein the outer tube has a second connection portion and the second cover has a third connection portion defined in an inside thereof, the second and third connection portions are connected with each other.

* * * * *

UNITED STATES PATENT AND TRADEMARK OFFICE

CERTIFICATE OF CORRECTION

PATENT NO. : 8,662,775 B1
APPLICATION NO. : 13/794707
DATED : March 4, 2014
INVENTOR(S) : Li-Mei Liu It is certified that error appears in the above-identified patent and that said Letters Patent is hereby corrected as shown below:

Title Page, Item (71) the Applicant should read
--(71) Applicant: Li-Mei Liu, Zhuhai, CHINA Title Page, Item (72) the Inventor should read
--(72) Inventor: Li-Mei Liu, Zhuhai, CHINA Signed and Sealed this
Thirteenth Day of May, 2014

Michelle K. Lee

Michelle K. Lee
*Deputy Director of the United States Patent and Trademark Office*